US009791163B2

(12) United States Patent
McKie et al.

(10) Patent No.: US 9,791,163 B2
(45) Date of Patent: Oct. 17, 2017

(54) METHOD OF DEFROSTING AN ENERGY RECOVERY VENTILATOR UNIT

(71) Applicant: Lennox Industries Inc., Richardson, TX (US)

(72) Inventors: Justin McKie, Dallas, TX (US); Eric Perez, Carrollton, TX (US); Herman Marcus Thomas, Carrollton, TX (US); Steve Schneider, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 262 days.

(21) Appl. No.: 14/641,090

(22) Filed: Mar. 6, 2015

(65) Prior Publication Data

US 2015/0241081 A1 Aug. 27, 2015

Related U.S. Application Data

(62) Division of application No. 13/293,454, filed on Nov. 10, 2011, now abandoned.

(51) Int. Cl.

| | |
|---|---|
| ***F24F 11/02*** | (2006.01) |
| ***F24F 11/00*** | (2006.01) |
| ***F24F 12/00*** | (2006.01) |

(52) U.S. Cl.

CPC ..... *F24F 11/0086* (2013.01); *F24F 12/006* (2013.01); *F24F 2011/0054* (2013.01); *F24F 2011/0087* (2013.01)

(58) Field of Classification Search

CPC ..... F24F 11/0086; F24F 12/006; F24F 2011/0054; F24F 2011/0087

USPC ..... 62/151, 155, 156

See application file for complete search history.

(56) References Cited

U.S. PATENT DOCUMENTS

| | | | |
|---|---|---|---|
| 3,252,508 | A | 5/1966 | Goettl |
| 3,889,742 | A | 6/1975 | Rush et al. |
| 4,018,266 | A | 4/1977 | Kay |
| 4,060,913 | A | 12/1977 | Yoshida et al. |
| 4,281,522 | A | 8/1981 | Bussjager |

(Continued)

OTHER PUBLICATIONS

Lennox Engineering Data, Indoor Air Quality ERV Energy Recovery Ventilator 60 HZ, Bulletin No. 210245, Mar. 2010, 20 pages.

(Continued)

*Primary Examiner* — Marc Norman
(74) *Attorney, Agent, or Firm* — Winstead PC

(57) ABSTRACT

A method of defrosting an energy recovery ventilator unit. The method comprises defrosting an energy recovery ventilator unit. The method comprises activating a defrost process of an enthalpy-exchange zone of the energy recovery ventilator unit when an air-flow blockage in the enthalpy-exchange zone coincides with a frost threshold in the ambient environment surrounding the energy recovery ventilator unit. The method also comprises terminating the defrost process when a heat transfer efficiency across the enthalpy-exchange zone returns to within 10 percent of a pre-frosting heat transfer efficiency wherein, the heat transfer efficiency is proportional to a temperature difference between an intake air zone of the energy recovery ventilator and a supply air zone of the energy recovery ventilator divided by a temperature difference between an return air zone of the energy recovery ventilator and the intake air zone.

11 Claims, 11 Drawing Sheets

(56) References Cited

U.S. PATENT DOCUMENTS

Figure 1:
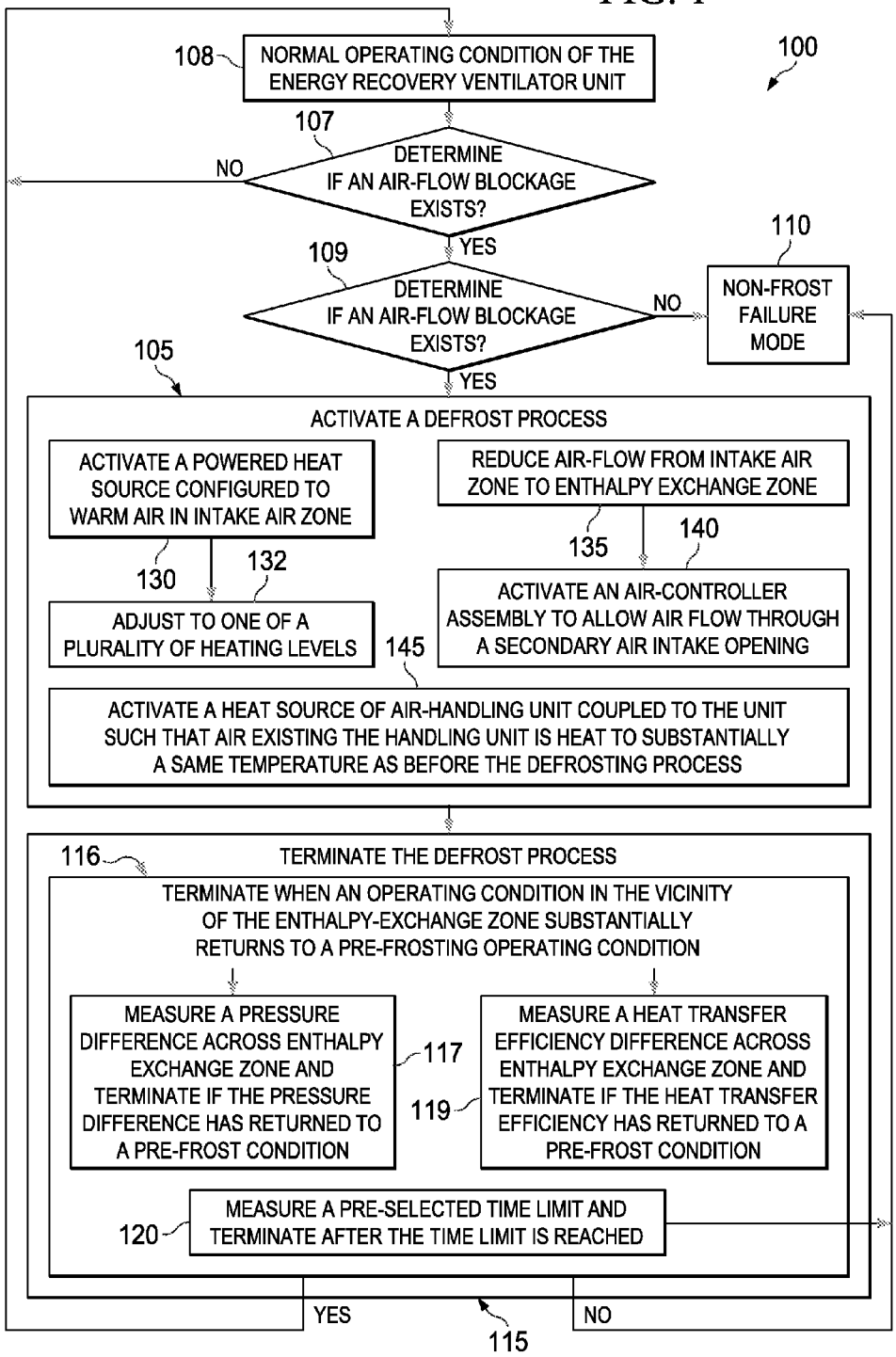

| | | | | |
|---|---|---|---|---|
| 4,611,653 | A | 9/1986 | Ikemura et al. | |
| 4,754,651 | A | 7/1988 | Shortridge et al. | |
| 4,843,838 | A | 7/1989 | Trask | |
| 4,854,726 | A | 8/1989 | Lesley et al. | |
| 5,173,922 | A | 12/1992 | Arakawa et al. | |
| 5,183,098 | A | 2/1993 | Chagnot | |
| 5,497,823 | A | 3/1996 | Davis | |
| 5,726,424 | A | 3/1998 | Koether | |
| 5,728,289 | A | 3/1998 | Kirchnavy et al. | |
| 5,761,908 | A | 6/1998 | Oas et al. | |
| 5,826,641 | A | 10/1998 | Bierwirth et al. | |
| 6,039,109 | A | 3/2000 | Chagnot et al. | |
| 6,209,622 | B1 | 4/2001 | Lagace et al. | |
| 6,289,974 | B1 | 9/2001 | DeGregoria et al. | |
| 6,328,095 | B1 | 12/2001 | Felber et al. | |
| 6,415,616 | B1 | 7/2002 | Kim | |
| 6,575,228 | B1 | 6/2003 | Ragland et al. | |
| 6,629,422 | B2 | 10/2003 | Wellman | |
| 6,925,999 | B2 | 8/2005 | Hugghins et al. | |
| 7,012,516 | B2 | 3/2006 | Laurosch et al. | |
| 7,073,566 | B2 | 7/2006 | Lagace et al. | |
| 7,090,000 | B2 | 8/2006 | Taylor | |
| 7,231,967 | B2 | 6/2007 | Haglid | |
| 7,440,864 | B2 | 10/2008 | Otto | |
| 7,716,936 | B2 | 5/2010 | Bailey et al. | |
| 7,856,289 | B2 | 12/2010 | Schanin et al. | |
| 8,123,518 | B2 | 2/2012 | Nordberg et al. | |
| 8,943,848 | B2 * | 2/2015 | Phannavong | F24F 12/001 62/160 |
| 9,175,872 | B2 | 11/2015 | McKie et al. | |
| 9,395,097 | B2 | 7/2016 | McKie et al. | |
| 9,404,668 | B2 | 8/2016 | McKie et al. | |
| 2002/0153133 | A1 | 10/2002 | Haglid | |
| 2003/0140638 | A1 | 7/2003 | Arshansky et al. | |
| 2003/0178411 | A1 | 9/2003 | Manganiello et al. | |
| 2004/0155466 | A1 | 8/2004 | Sodermann et al. | |
| 2005/0236150 | A1 | 10/2005 | Chagnot et al. | |
| 2006/0035580 | A1 | 2/2006 | Anderson et al. | |
| 2006/0054302 | A1 | 3/2006 | Cho et al. | |
| 2006/0219381 | A1 | 10/2006 | Lagace et al. | |
| 2007/0045439 | A1 | 3/2007 | Wolfson | |
| 2007/0045601 | A1 | 3/2007 | Rhee | |
| 2007/0144187 | A1 | 6/2007 | Lee | |
| 2007/0171647 | A1 | 7/2007 | Artwohl et al. | |
| 2007/0205297 | A1 | 9/2007 | Finkam et al. | |
| 2007/0234748 | A1 | 10/2007 | Alvord et al. | |
| 2008/0076346 | A1 | 3/2008 | Ahmed | |
| 2008/0144238 | A1 | 6/2008 | Cline et al. | |
| 2008/0208531 | A1 | 8/2008 | Felcman et al. | |
| 2008/0282494 | A1 | 11/2008 | Won et al. | |
| 2009/0095096 | A1 | 4/2009 | Dean et al. | |
| 2009/0156966 | A1 | 6/2009 | Kontschieder et al. | |
| 2013/0118188 | A1 | 5/2013 | McKie et al. | |
| 2015/0204578 | A1 * | 7/2015 | Kaiser | F24H 3/065 237/55 |

OTHER PUBLICATIONS

Shapiro, Ian, P.E., "Water & Energy Use in Steam-Heated Buildings," ASHRAE Journal, May 2010, 6 pages.

* cited by examiner

METHOD OF DEFROSTING AN ENERGY RECOVERY VENTILATOR UNIT

CROSS REFERENCE TO RELATED APPLICATIONS

This application is a divisional application of U.S. patent application Ser. No. 13/293,454 entitled "Method of Defrosting an Energy Recovery Ventilator Unit, filed on Nov. 10, 2011 which is related to U.S. patent application Ser. No. 13/274,629, by McKie et al., entitled, "DESIGN LAYOUT FOR AN ENERGY RECOVERY VENTILATOR SYSTEM" ("Appl-1"), filed on Oct. 17, 2011, U.S. patent application Ser. No. 13/267,542, by McKie et al., entitled, "DETECTING AND CORRECTING ENTHALPY WHEEL FAILURE MODES" ("Appl-2"), filed on Oct. 6, 2011, and U.S. patent application Ser. No. 13/267,492, by McKie et al., entitled, "ERV GLOBAL PRESSURE DEMAND CONTROL VENTILATION MODE" ("Appl-3"), filed on Oct. 6, 2011, all of which are incorporated herein by reference in their entirety. One or more of the above applications may describe embodiments of Energy Recovery Ventilator Units components and processes thereof that may be suitable for making and/or use in some of the embodiments described herein.

TECHNICAL FIELD

This application is directed, in general, to space conditioning systems and methods for conditioning the temperature and humidity of an enclosed space using an energy recovery ventilator unit, and in particular, to methods and devices for defrosting energy recovery ventilator units.

BACKGROUND

Energy recovery ventilator units are often used in space conditioning systems to maintain air quality while minimizing energy losses. Sometimes the energy recovery ventilator unit can become frosted, thereby reducing the functionality of the unit.

SUMMARY

One embodiment of the disclosure is a method defrosting an energy recovery ventilator unit. The method comprises activating a defrost process of an enthalpy-exchange zone of the energy recovery ventilator unit when an air-flow blockage in the enthalpy-exchange zone coincides with a frost threshold in the ambient environment surrounding the energy recovery ventilator unit. The method also comprises terminating the defrost process when a heat transfer efficiency across the enthalpy-exchange zone returns to within 10 percent of a pre-frosting heat transfer efficiency wherein, the heat transfer efficiency is proportional to a temperature difference between an intake air zone of the energy recovery ventilator and a supply air zone of the energy recovery ventilator divided by a temperature difference between an return air zone of the energy recovery ventilator and the intake air zone.

Another embodiment is an energy recovery ventilator unit. The energy recovery ventilator unit comprises a defrost control module configured to activate the defrost process and to terminate the defrost process, as described above.

BRIEF DESCRIPTION

Figure 2:
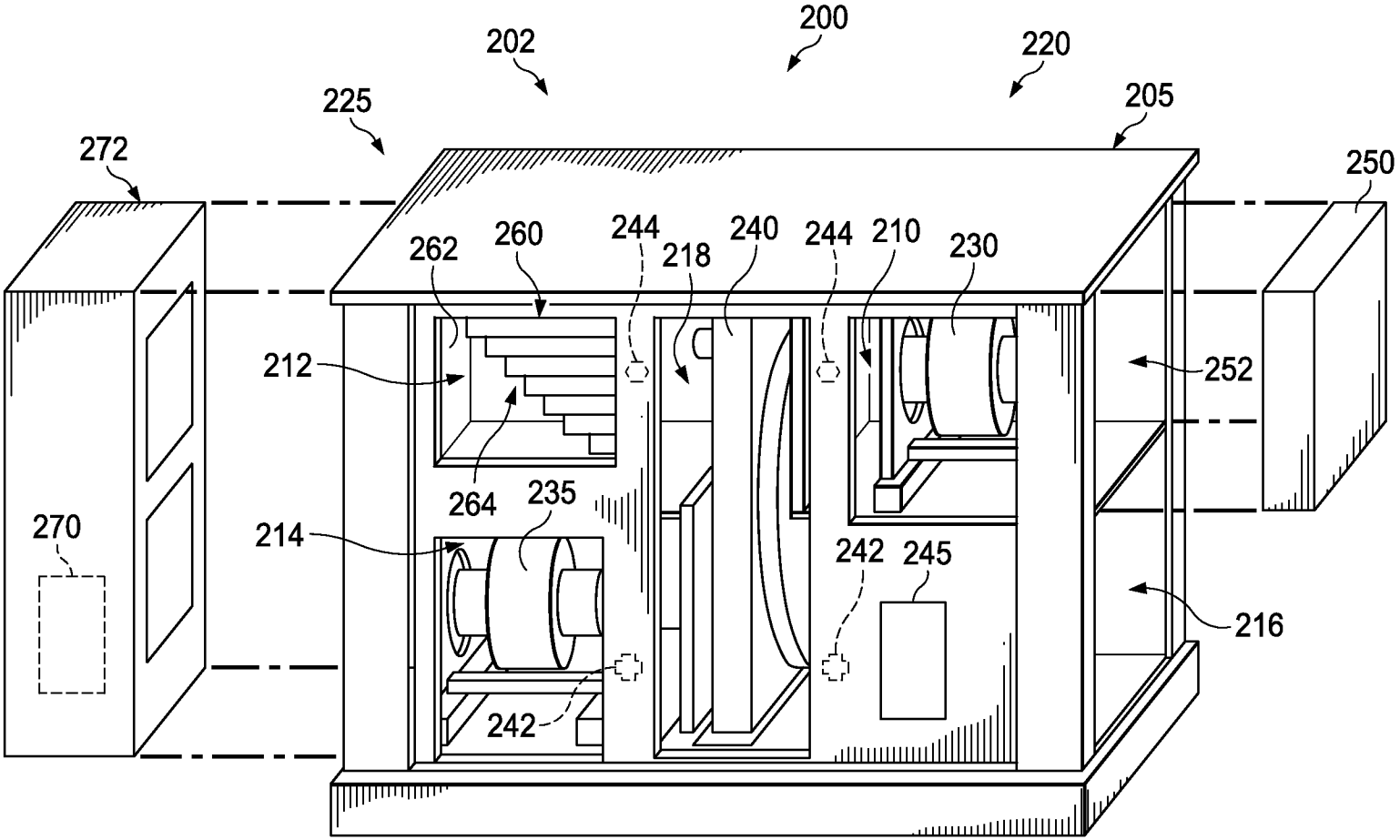
Figure 3A:
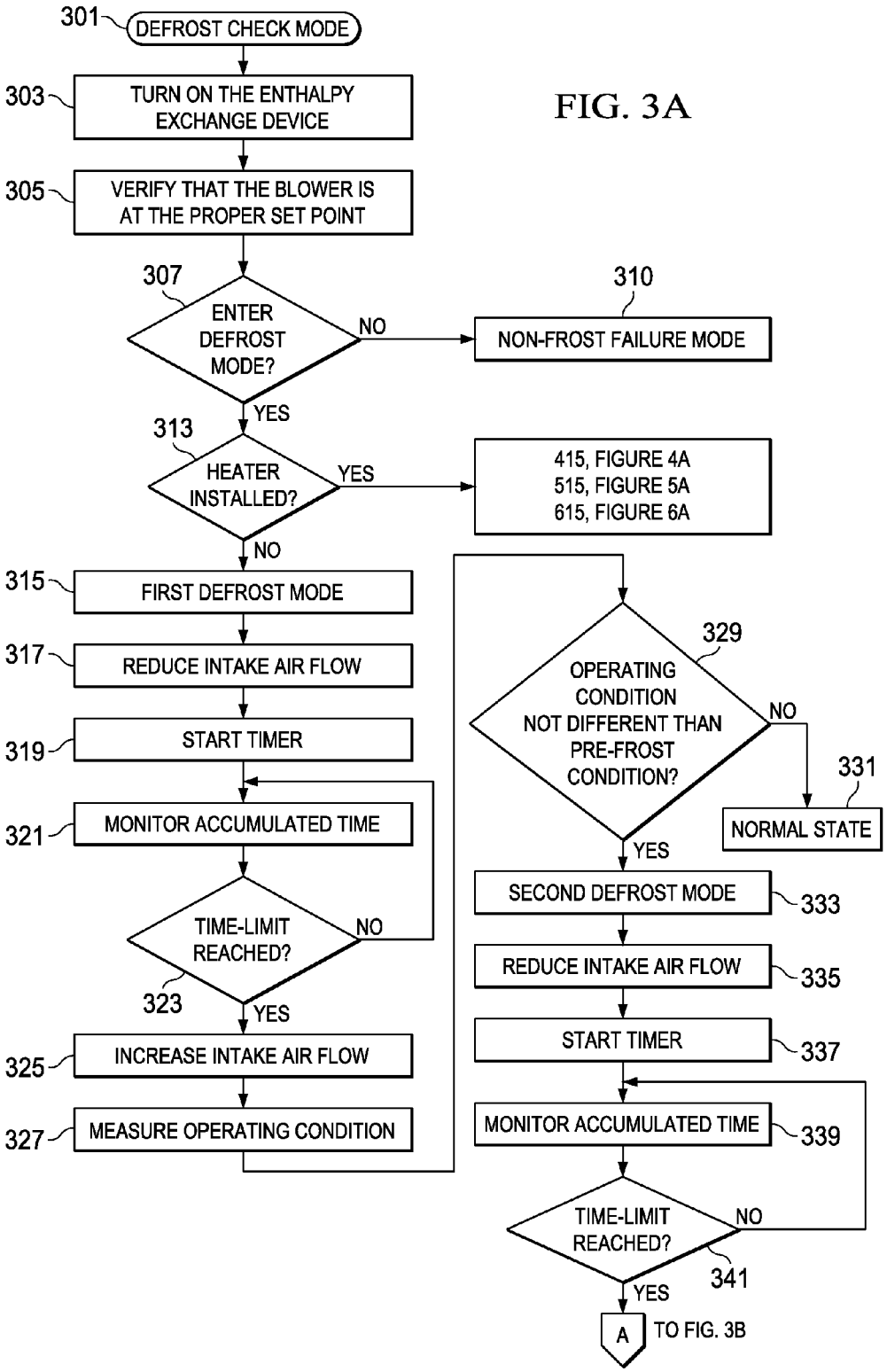
Figure 3B:
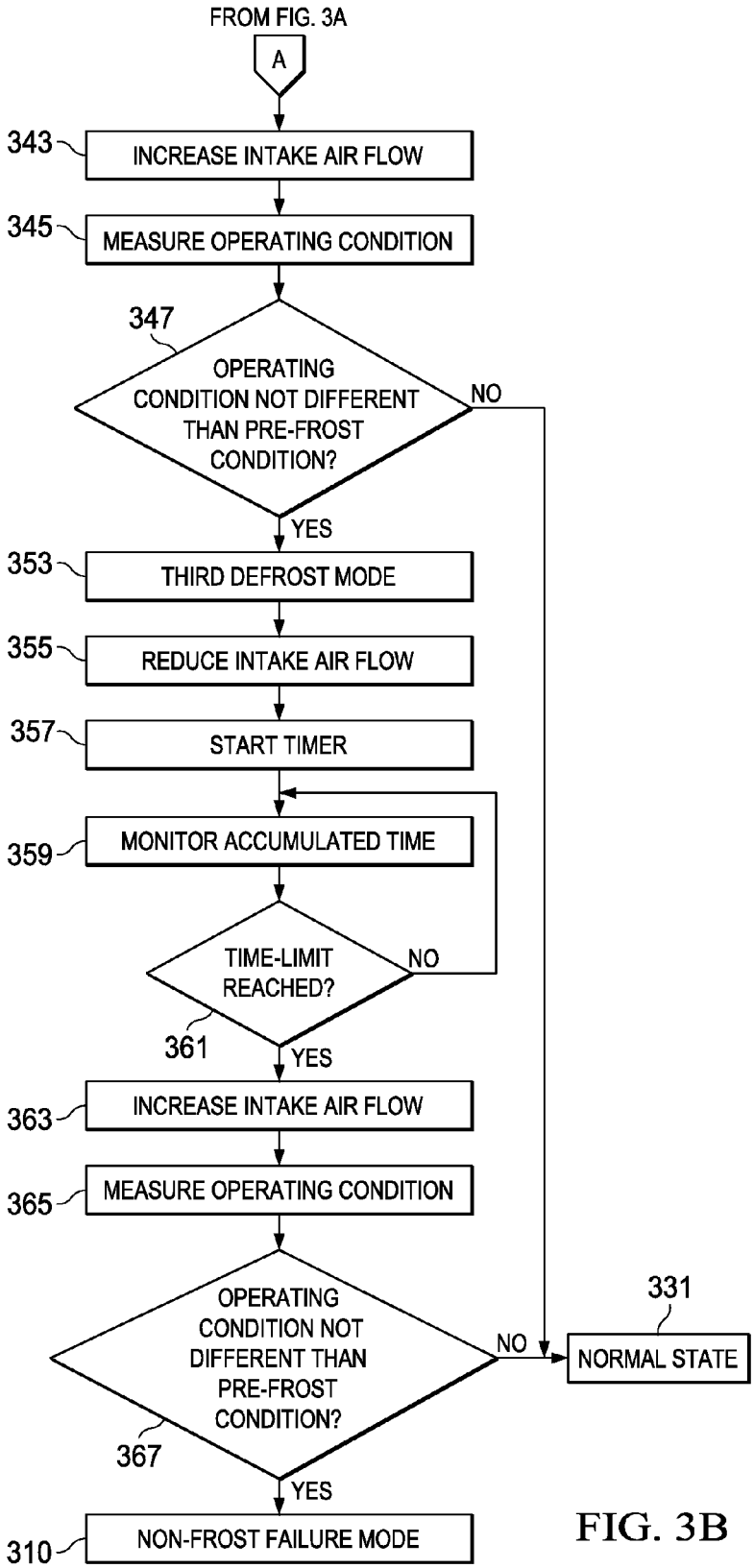
Figure 4A:
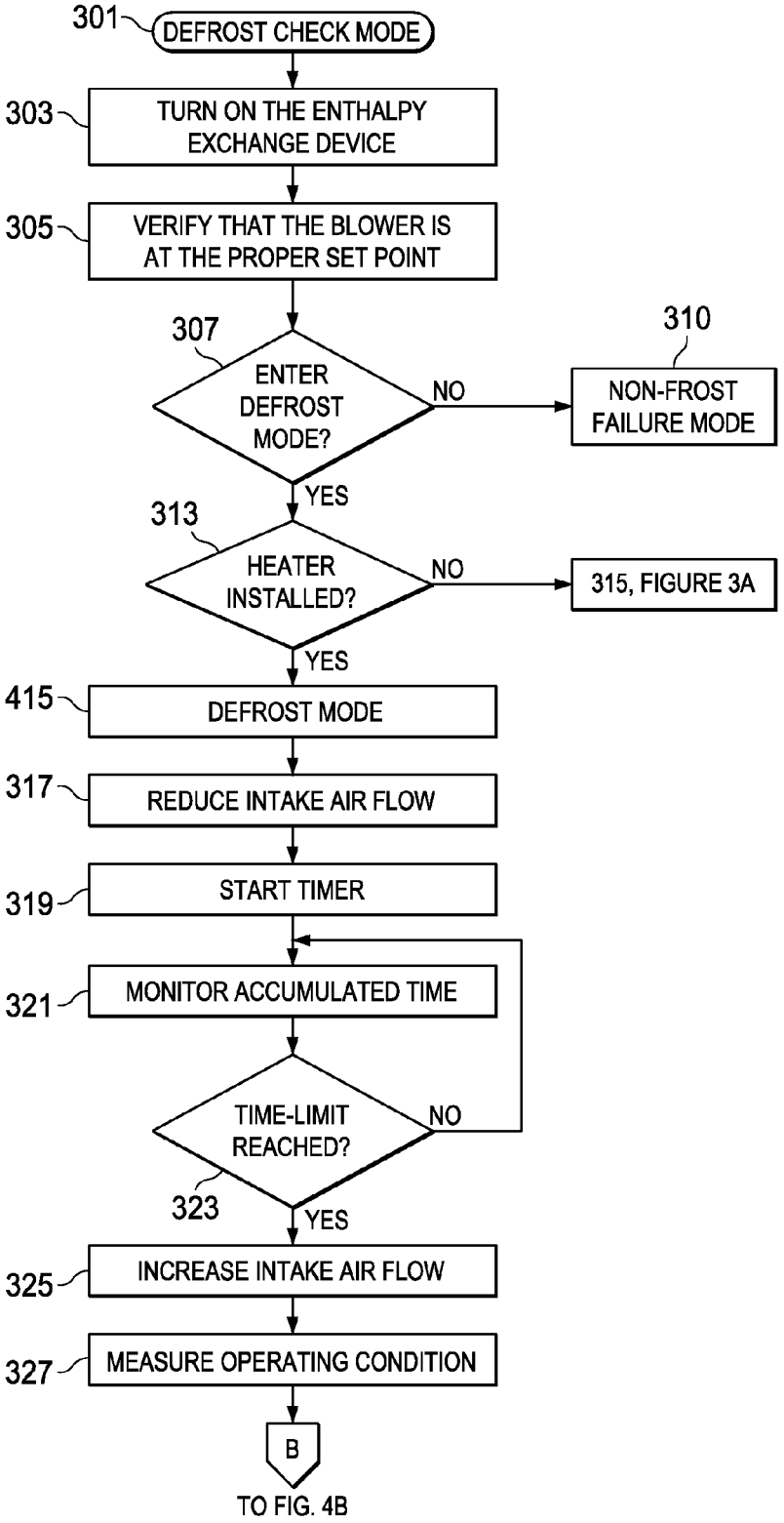
Figure 4B:
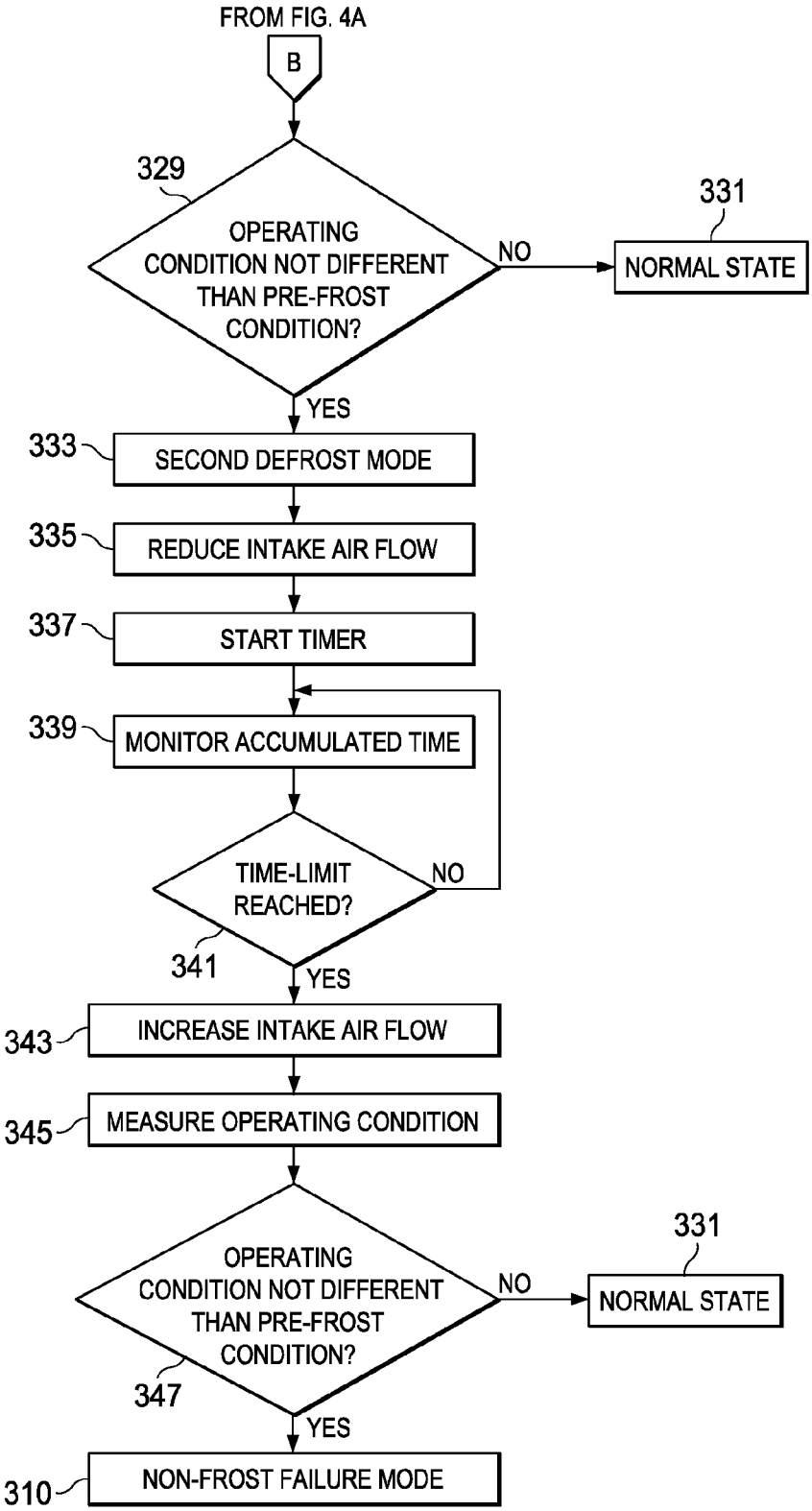
Figure 5A:
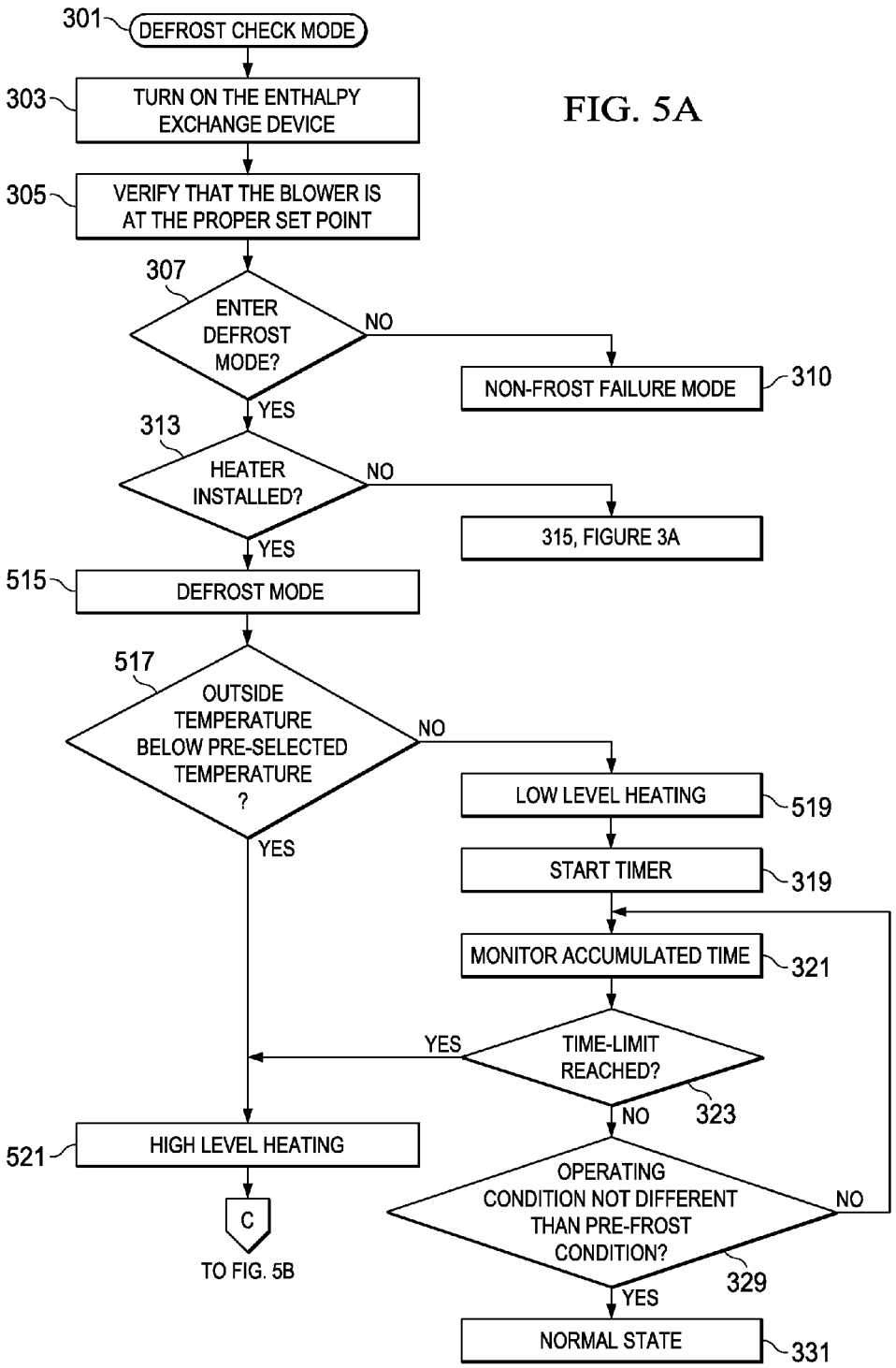
Figure 5B:
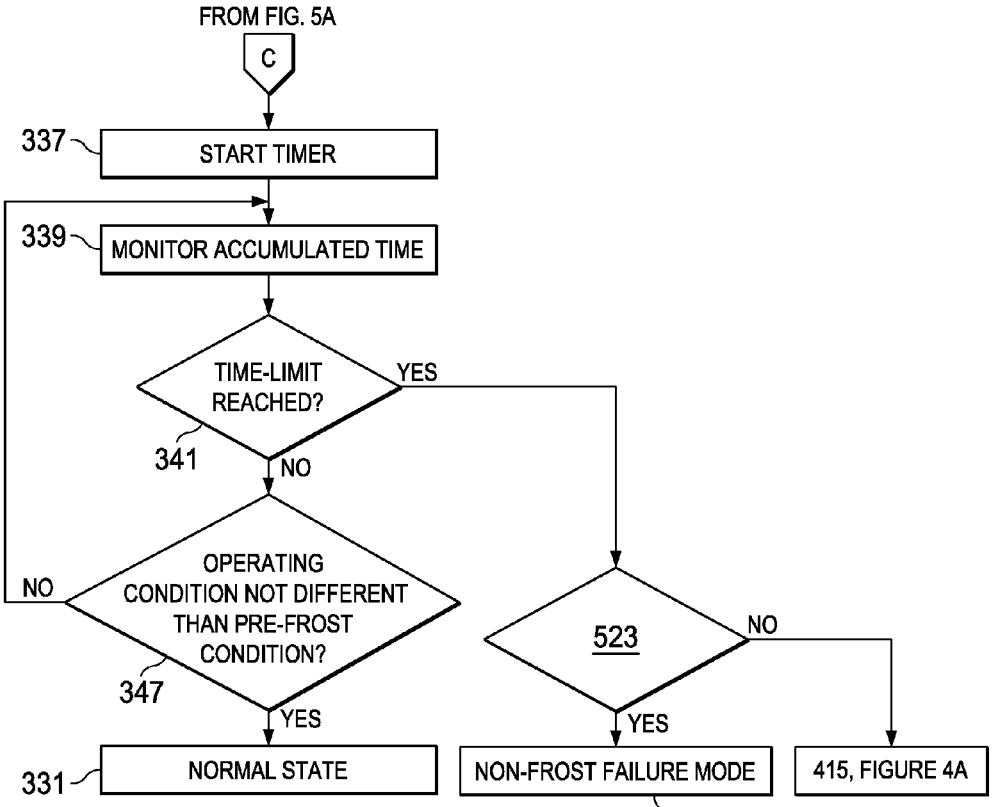
Figure 6A:
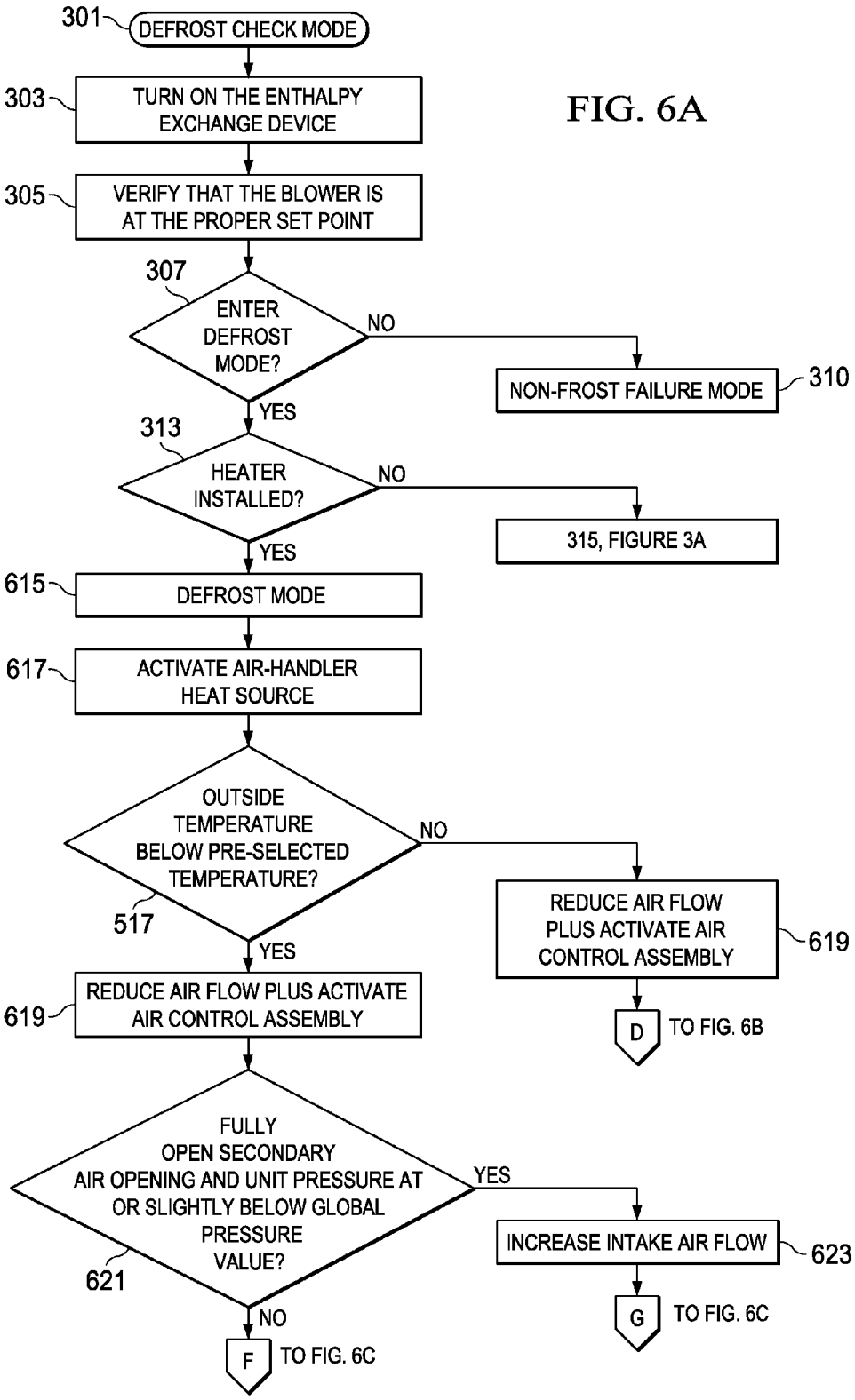
Figure 6B:
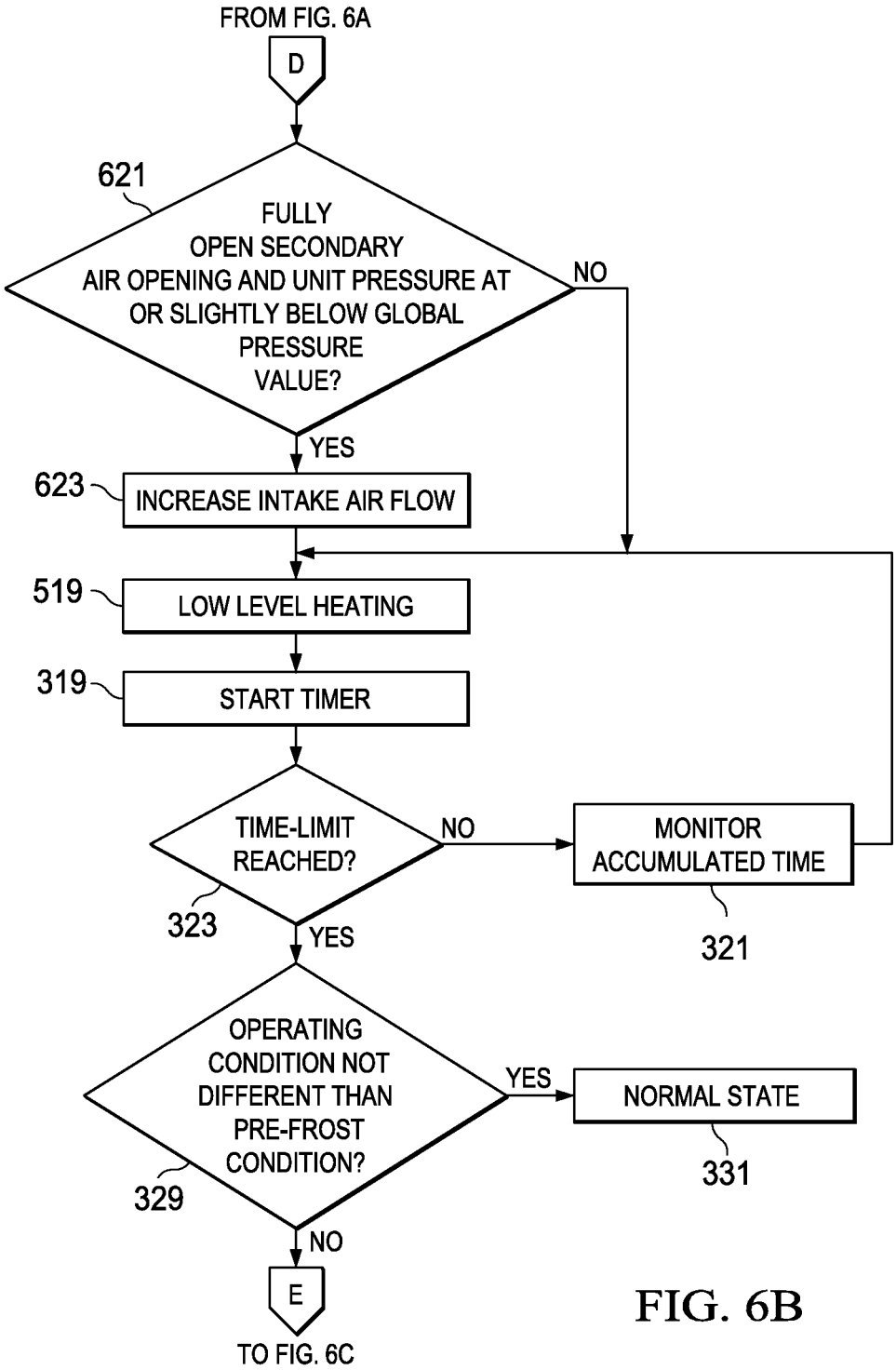
Figure 6C:
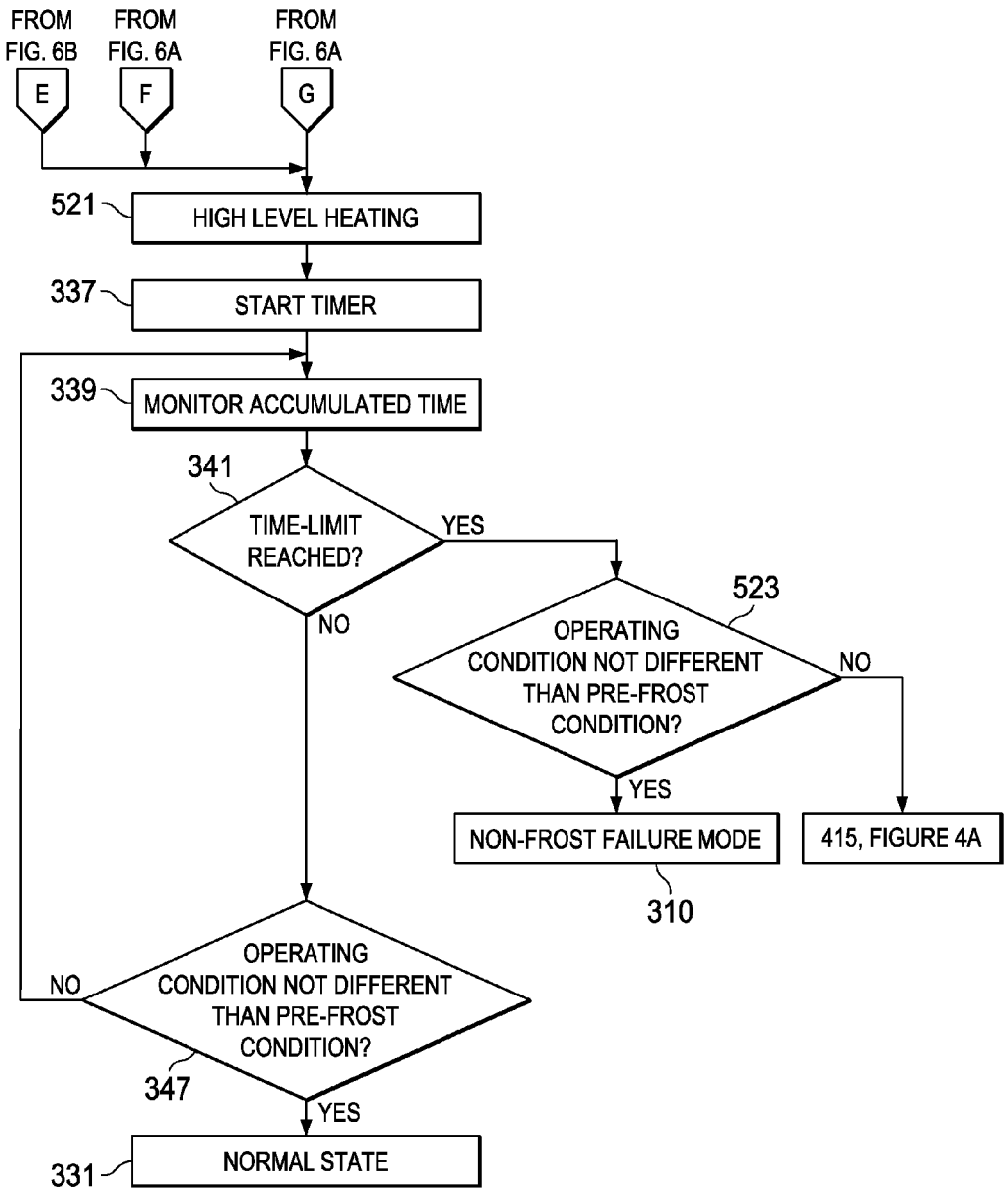

Reference is now made to the following descriptions taken in conjunction with the accompanying drawings, in which:

FIG. 1 presents a flow diagram showing selected steps in an example method of defrosting an energy recovery ventilator unit according to the principles of the disclosure;

FIG. 2 presents an cross-sectional view of an example energy recovery ventilator unit of the present disclosure;

FIG. 3A and FIG. 3B present a flow diagram of an example implementation of the method of the disclosure in the case where the energy recovery ventilator unit does not include a powered heat source or a secondary air-intake opening;

FIG. 4A and FIG. 4B present a flow diagram of another example implementation of the method of the disclosure in the case where the energy recovery ventilator unit does include a powered heat source but does not include a secondary air intake opening;

FIG. 5A and FIG. 5B present a flow diagram of another example implementation of the method of the disclosure in the case where the energy recovery ventilator unit does include a powered heat source 250 but not a secondary air-intake opening; and FIG. 6A, FIG. 6B and FIG. 6C present a flow diagram of another example implementation of the method of the disclosure in the case where the energy recovery ventilator unit does include a powered heat source and a secondary air-intake opening.

DETAILED DESCRIPTION

The term, "or," as used herein, refers to a non-exclusive or, unless otherwise indicated. Also, the various embodiments described herein are not necessarily mutually exclusive, as some embodiments can be combined with one or more other embodiments to form new embodiments.

It is desirable to have an efficient and flexible method for defrosting an energy recovery ventilator unit that both minimizes the energy expended for defrosting and minimizes the time spent when the energy recovery ventilator unit is not in its normal operating mode.

FIG. 1 presents a flow diagram showing selected steps in an example method of defrosting an energy recovery ventilator unit according to the principles of the disclosure. To facilitate understanding of the flow diagram presented in FIG. 1, FIG. 2 presents a perspective view of an example energy recovery ventilator unit 200 of the disclosure, which can include but is not limited to, any of the design layouts and any of the components parts described in Appl-1. The unit 200 can be part of a space conditioning system 202.

For instance, the unit 200 can comprise a cabinet 205 housing an intake air zone 210 (e.g., sometimes a primary intake air zone), a supply air zone 212, a return air zone 214, an exhaust air zone 216 and an enthalpy-exchange zone 218. The intake zone 210 and the exhaust zone 216 are both on one side 220 of the enthalpy exchange zone 218, and, the supply zone 212 and the return zone 214 are both on an opposite side 225 of the enthalpy exchange zone 218. The energy recovery ventilator unit 100 also comprises a first blower 230 and a second blower 235. The first blower 230 is located in the intake zone 210 and is configured to push, or alternatively pull, outside air into the intake zone 210 and straight through the enthalpy exchange zone 218 into the supply zone 212. The second blower 235 is located in the return zone 214 and is configured to push, or alternatively pull, return air into the return zone 214 and straight through the enthalpy exchange zone 218 into the exhaust zone 216. The enthalpy exchange zone 218 can include one or more enthalpy-exchanger devices 240 configured as one or more enthalpy wheels or other enthalpy-exchange devices such as plated heat exchangers or heat pipes or other devices familiar to those skilled in the art. As further illustrates the unit can further include a defrost control module 245 which as illustrated, can be located on the outside surface of the cabinet 205 although other located are within the scope of the disclosed unit 200.

Returning to FIG. 1, the method 100 of defrosting the energy recovery ventilator unit 200 comprises a step 105 of activating a defrost process of an enthalpy-exchange zone 218 of the energy recovery ventilator unit 200 when an air-flow blockage in the enthalpy-exchange zone 218 coincides with a frost threshold in the ambient environment surrounding the energy recovery ventilator unit 200.

As further illustrated in FIG. 1 some embodiments of the method 100 can include a step 107 of determining if an air-flow blockage exists in the enthalpy-exchange zone 218. Step 107 can include any of the processes described in Appl-2 for determining the presence of an air-flow blockage through an enthalpy-exchange zone 218. In some cases step 107 can include determining a pressure difference across the enthalpy-exchange zone 218 while the energy recovery ventilator unit 200 is operating. In other cases, step 107 can include determining a heat transfer efficiency across the enthalpy-exchange zone 218 while the energy recovery ventilator unit 200 is operating. The pressure or heat transfer efficiency can be compared to the analogous operational characteristic of pressure or heat transfer when the unit 200 determined during step 108 when the unit 200 was in a known normal operating condition. When the pressure difference increases or heat transfer decreases beyond a predefined limit the presence of an air-flow blockage is signaled, such as disclosed in Appl-2.

As also in FIG. 1, some embodiments of the method 100 can include a step 109 of determining if the air-flow blockage in the enthalpy-exchange zone coincides with a frost threshold existing in the ambient environment surrounding the unit 200.

The term, frost threshold, as used herein, refers to a pre-selected temperature value corresponding to the measured ambient air-temperature surrounding the energy recovery ventilator unit at which frost formation will occur. In some cases, for example, the frost threshold can correspond to a pre-selected temperature value in a range of 20 to 32° F. In some cases, the frost threshold can be pre-selected temperature value that is adjusted depending on the relative humidity within energy recovery ventilator unit 200. For example, in some cases, the frost threshold may be a temperature value of 20° F. when the relative humidity is low (e.g., 30 percent or lower) but linearly adjusted to 32° F. as the relative humidity reaches 100 percent.

As illustrated for the example method 100 shown in FIG. 1, when there is both an air-flow blockage (e.g., yes, in step 107) in the enthalpy-exchange zone 218 and there is a frost threshold (e.g., yes, in step 109) the defrost process (step 105) can be activated. Alternatively, when there is an air-flow blockage (yes, in step 107) in the enthalpy-exchange zone 218 but there is a frost threshold (no in step 109) then a non-frost failure mode step 110 can be activated. This can advantageously prevent the unit 200 from going into a defrost mode when it is determined a frosting condition unlikely to have occurred. The procedures followed when the non-frost failure mode (step 110) is activated can include any of the processes described in Appl-2.

As shown in FIG. 1, the method 100 also comprises a step 115 of terminating the defrost process, including a step 116 of terminating the defrost process when an operating condition in the vicinity of the enthalpy-exchange zone 218 substantially returns to a pre-frosting operating condition. The term operating condition, as used herein, refers to an environmental conditions or properties at one or more locations in the unit 200 that is measurable while the unit 200 is operating either before or during the defrost process (step 110). The term pre-frosting operating condition refers to the environmental condition when the unit 200 was in a normal operating state step 108 (e.g., prior to detecting a air-flow blockage in step 107)

It is often desirable for the defrost process to continue for as short a period as possible, because defrosting can reduce the energy and heat transfer efficiency of the unit 200, and in some cases damage components (e.g., the enthalpy-exchanger devices 240) of the unit 200. In some cases, minimizing the defrosting time can be facilitated by providing multiple different criteria for terminating the defrost process. Consequently, terminating the defrost process can include monitoring one or more different operating conditions of the unit 200.

For instance, in some cases, terminating the defrost process (step 115) can further include a step 117 of determining the operating condition (as part of step 116), which includes measuring an air-pressure difference across the enthalpy-exchange zone 218 while the unit 200 is operating. For example, pressure transducers 242, situated on either side of the enthalpy zone 218, can monitor the pressure during defrost process (step 110) as well as during pre-defrost conditions, such as determined, e.g., during a normal operating state (step 109). In such cases, terminating the defrost process (step 115) includes terminating after the operating condition, corresponding to the measured air-pressure difference across the enthalpy-exchange zone 218, has decreased to substantially equal to (e.g., within ±10% in some cases) the pre-frosting operating condition, corresponding to an air-pressure difference across the enthalpy-exchange zone 218 measured prior to activating the defrost process (e.g., measured during step 109).

For instance, in some cases, terminating the defrost process (step 115) further includes a step 119 of determining the operating condition (as part of step 116), which includes measuring a heat transfer efficiency across the enthalpy-exchange zone 218 while the unit 200 is operating.

For example, temperature sensors 244, situated on either side of the enthalpy zone 218, can monitor the temperature during defrost process (step 110) as well as during pre-defrost conditions, such as determined, e.g., during a normal operating state (step 109). The heat transfer efficiency is proportional to the ratio of: the temperature difference between the intake air zone 210 and the supply air zone 212 divided by the temperature difference between the return air zone 214 and the intake air zone 210. The temperature difference between the difference between return air zone 214 and intake air zone 210 is considered to represent the overall heat transfer occurring in the unit 200, e.g., that drives energy transfer, while the temperature difference between the intake air zone 210 and the supply air zone is considered to represent the actual heat transfer occurring.

In such cases, terminating the defrost process (step 115) includes terminating after the operating condition, corresponding to the measured heat transfer efficiency across the enthalpy-exchange zone 218, has decreased to be substantially equal to (e.g., within ±10% in some cases) the pre-frosting operating condition, corresponding to a heat transfer efficiency across the enthalpy-exchange zone 218 measured prior to activating the defrost process (e.g., measured during step 109).

In some embodiments, however, if the operating condition has not substantially returned to a pre-frosting operating condition, then the non-defrost failure mode (step 110) is entered.

In some cases, it is also desirable to terminate the defrost process (step 115) after a measured pre-selected time limit is reached (step 120). This can advantageously prevent excessive energy and time being expended on defrosting when the enthalpy exchange zone 218 is blocked for reasons other than frosting. In some cases, if the time limit measured in step 120 has reached the pre-selected time limit (e.g., a defrosting time limit has expired), the non-defrost failure mode (step 110) is entered.

To facilitate minimizing the defrosting time and minimizing the energy expended on defrosting, some embodiments of the method 100 provide multiple defrosting strategies that can be implemented, either alone or in combination, as part of the defrosting process 105, and implements in a fashion that depends on the ambient environmental conditions surrounding the unit 200 or on the components that are included in the unit 200.

For instance, in some embodiments, the activated defrost process (step 105) further includes a step 130 of activating a powered heat source 250 configured to warm air in the intake air zone 210 or the exhaust air zone 216 located inside of the unit 200. The powered heat source 250 can pre-heat the ambient cold air outside of the unit to thereby facilitate rapid defrosting. In some cases, the powered heat source 250 can be an electric heater. However, in other cases, a gas-fired heat exchanger could be used. In some cases, the powered heat source 250 is, or includes, a modular electric heater coupled to the outside of the unit 200 and located upstream of an air intake opening 252 of the intake air zone 210. The term modular electric heater, as used herein, refers to a self-contained heater that includes one or more of temperature sensors, electrical power connections, device control connections, as integral parts of the heater 250, thereby facilitating field-installation of the heater 250, e.g., to a previously installed unit 200.

In some embodiments, activating the powered heat source 250 in step 130 further including a step 132 of adjusting the powered heat source 250 to one of a plurality of different levels of heat generation as a function of an ambient air temperature surrounding the unit 200. For instance, if the ambient air temperature is at or below a pre-selected set-point (e.g., 20° F. in some cases) then the heater 250 can be adjusted to a high level of heating. If the ambient air temperature is above the set-point then the heater 250 can be adjusted to a low level of heating. Having the ability to adjust to plurality of different levels facilitates using the full heating the potential of the heater at certain times, but, avoiding excessive heating at other times, that could damage, e.g., due to melting or softening of plastic parts in the enthalpy exchange device 240, or other components of the unit 200.

For instance, in some embodiments, the activated defrost process (step 105) further includes a step 135 of reducing airflow from an air intake zone 210 located inside of the unit 200 to the enthalpy exchange-zone 218. For instance, the speed of the air blower 230 located in the intake air zone 210 can be reduced. For instance, in some cases the speed of the air blower 230 is reduced by about 20 to 30 percent as compared to the speed of the air blower when the unit 200 is in its normal operating state (e.g., step 108). Reducing the airflow can facilitate defrosting because the amount of cold air drawn into the unit 200 from the ambient outside air is reduced. In some cases, when the unit 200 includes the powered heat source 250, reducing the airflow from the air-intake zone 210 (step 135) at or during the same time as activating the heat source 250 (step 130) can speed defrosting because the temperature of the air reaching the enthalpy zone 218 is increased.

In some embodiments, the activated defrost process (step 105) further includes a step 140 of activating an air controller assembly 260 so as to allow air-flow through a secondary air-intake opening 262 connected to the supply zone 212 located inside of the unit 200. As further disclosed in Appl-1, the air controller assembly 260 can include baffles or dampers 264 which are configured to be continuously adjustable to allow substantially no air, to large volumes of air, to pass through the secondary intake opening 260. In FIG. 2, only a partial cut-away view of the example air controller assembly 260 is depicted so that the supply air zone 212 and secondary input opening 262 can be more clearly depicted.

As illustrated in FIG. 1 in some cases, the air controller assembly 260 is activated in step 140 when the air flow through the primary air intake zone 210 is reduced in step 135. In some applications (e.g., schools, hospitals), allowing air through the secondary air-intake opening 262 is important to meeting certain fresh air requirements that must be met, even when performing the defrost process (step 105). In some cases, to facilitate meeting the fresh air requirements, the reduction in the air flow from the air intake zone 210 and an increase in the air-flow through the secondary air-intake opening 262 are coordinated such that the air-pressure inside of the unit 200 substantially equals an ambient air pressure surrounding unit 200. Examples of some such embodiments are further described in Appl-3 in the context of using measurements from a global demand pressure sensor of the unit 200 as part of controlling the air controller assembly 260 and thereby achieving the desired amount of air-flow through a secondary air-intake opening 262 to meet the fresh air requirements. In some cases, the air controller assembly 260 is activated such that there is a slightly negative pressure compared to the global demand pressure (e.g., within about 0.1 to −0.2 inches, water column) to ensure that any air conditioned by the enthalpy exchange zone 218 does not get blown out of the unit 200 (e.g., through the secondary air-intake opening 262) before being transferred into an air-handler unit 272, (e.g., heating ventilation and cooling system, such as a roof top unit), coupled to the unit 200.

In some embodiments, the defrost process (activated in step 105) further includes a step 145 of activating a heat source 270 of an air-handling unit 272 that is coupled to the unit 200, such that the air exiting the air-handling unit 272 is heated to a substantially same temperature than before the defrosting process was activated (step 105). The heater 270 of the air-handling unit 272 can be a gas-fired heater, electric heater or other heater familiar to those skilled in the art. As illustrated in FIG. 2 the air-handling unit is located downstream, and configured to receive air, from the unit 200. The air-handling unit can be part of the space conditioning system 202.

Activating the heat source 270 of an air-handling unit 272 in step 145 can advantageously heat cold outside air through the secondary air-intake opening 262 and thereby make the conditioned space more comfortable during the defrosting process 115. In some cases, the heat source 270 in the air-handling unit 272 is activated in step 145 at the same time, or before, the air controller assembly is activated in step 140. For instance, in some cases, activating the air controller assembly in step 140 causes dampers 264 covering the secondary air-intake opening 262 to take one to two minutes to fully open. During this time, activating the heater 270 can pre-heat the air such that when the secondary air-intake opening 262 is fully opened, the air reaching the conditioned space is preheated to substantially same temperature as before the defrosting process started.

Another embodiment of the disclosure is the energy recovery ventilator unit 200, which can comprise any of embodiments of the unit 200 discussed in the context of FIG. 1 and presented in FIG. 2. For instance, the unit 200 comprises a defrost control module 245 is configured to activate the defrost process (step 105) and terminate the defrost process (step 115), such as disclosed in the context of FIG. 1. Embodiments of the unit 200 can include the components such as the intake air zone, 210, supply air zone 212, return air zone 214, exhaust air zone 216, enthalpy exchange zone 218, as disclosed above and as further disclosed in Appl-1, Appl-2 and Appl-3.

For instance, the unit 200 can include pressure transducers 242 configured to measuring an air-pressure difference across the enthalpy-exchange zone 218 while the unit 200 is operating. The pressure transducers 242 can be configured to transmit the measured air pressure difference to the defrost control module 245, and the defrost control module 245 can be configured to determine the operating condition as including the air-pressure difference in accordance with step 117.

For instance, the unit 200 can include temperature sensors configured to measuring air temperatures 244 of the intake zone 210, a supply air zone 212, and a return air zone 214 located inside of the unit 200. The temperature sensors 244 can be configured to transmit the measured air temperatures to the defrost control module 245. The defrost control module 245 can be configured to determine the operating condition as including a heat transfer efficiency determined from the measured air temperatures, in accordance with step 119.

For instance, the defrost module 245 can be configured to terminate the defrost process (step 115) after a preselected time limit is reached. In some embodiments, e.g., the defrost module 245 includes an electronic timing circuit that monitors the time when the defrost process was activated in step 105, and compare the accumulated defrosting time to the preselected time limit, e.g., as set by factory or installation personnel.

For instance, the unit 200 can further include a powered heat source 250 configured to warm air in the intake air zone 210 or the exhaust air zone 216 located inside of the unit 200, and the defrost control module can be configured to activate or deactivate the heat source 250. In some embodiments the powered heat source 250 includes, or is, a modular electric heater configured to be coupled to the outside of the unit 200 and located upstream of the air intake opening 252 of the intake air zone 210.

For instance, the defrost module 245 can be configured to control the airflow from the air intake zone 210 located inside unit 200 to the enthalpy exchange-zone 218. In some embodiments, e.g., the defrost module 245 includes an electronic circuit configured to control the speed of the air intake blower 250 located in the intake air zone 210, in accordance with step 135.

For instance, the unit 200 can further include an air controller assembly 260 configured to adjust an amount of air-flow through a secondary air-intake opening 262 connected to a supply zone 212 located inside of the unit 200, and the defrost control module 245 can be configured to control the air controller assembly 260 to increase or decrease the amount of air allowed through the secondary air-intake opening 262.

For instance, the defrost control module 245 can be configured the control a heat source 270 of an air-handling unit 272 that is coupled to the unit 200. In some embodiments, e.g., the defrost module 245 includes an electronic circuit that is configured to activate the heat source 272, e.g., when there is air flowing through the secondary intake air opening 262, such that the air exiting the space conditioning system is heated to a substantially same temperature than before the defrosting process was activated. The electronic circuit can be configured to deactivate the heat source 272, when the defrosting process in terminated in step 115, or when there is not longer air flowing through the secondary intake air opening 262.

Aspects of the disclosed method of defrosting are further illustrated in FIGS. 3A, 3B, 4A, 4B, 5A, 5B, 6A, 6B and 6C, which present of example implementations of the method 100 and the unit 200.

FIG. 3A and FIG. 3B present a flow diagram of an example implementation of the method 100 in the case where the unit 200 does not include a powered heat source 250 or a secondary air-intake opening 262. The method 100 can include a starting a defrost check mode (step 301) which can include: step 303 of turning on the enthalpy exchange device 240 (e.g., make sure an enthalpy wheel device 240 is rotating), step 305 of verifying that the blower 250 is at the proper set point for heat transfer to occur, and step 307 (an example of step 109) of deciding whether to enter defrost mode including, e.g. measuring the outside air temperature and determining if the temperature is above the frost threshold. The defrost check (step 301) can include entering a non-frost failure mode step 310 (an example of step 110), if it is decided, in step 307, that the blockage is not due to frost formation. The defrost check (step 301) can include a step 313 of deciding if there is a heater 250 installed. If there is a heater 250 installed, then other procedures such as set forth in FIGS. 4A, 4B, 5A, 5B, 6A, 6B and 6C may be followed. If there is not a heater 250 installed, then a blower defrost mode (step 315) is entered (an example of step 105).

The blower defrost mode (step 315) can include a step 317 of reducing the air flow to the enthalpy exchange zone 218 e.g., by increasing the speed of the blower 230 (an example of step 135), a step 319 of commencing a timer, a step 321 of monitoring the accumulated time and determining in step 323 if a time-limit is reached (examples of step 120). If the time-limit is reached, a step 325 of further increasing the air flow (e.g., such as the air flow prior to step 317) is activated and in step 327 the operating condition (e.g., pressure difference and/or heat transfer efficiency) is measured (an example of steps 116, 117, 119). In step 329, it is decided if the operating condition (e.g., pressure or heat transfer efficiency) is not different than the pre-frosting operating condition. If there is no difference, then the blower defrost mode (step 315) is terminated (an example of step 115) and the unit 200 returns to a normal operating state in step 331 (an example of step 108). If there is still a difference in the operating condition compared to the pre-frosting condition, then a second blower defrost mode (step 333) is entered (an example continuation of step 105).

The second blower defrost mode (step 333) includes steps 335, 337, 339, 341, 343, 345, and 347 which are analogous to steps 317, 319, 321, 323, 325, 327, and 329, respectively, with the exception that the air flow reduction in step 335 is greater than the air flow reduction in step 317 (e.g., blower 230 speed is further lowered).

If there is still a difference in the operating condition (e.g., pressure difference or heat transfer efficiency) compared to a pre-frosting operating condition, then a third blower defrost mode (step 353) is entered (an example of continuing step 105). Again the third blower defrost mode (step 353) includes steps 355, 357, 359, 361, 363, 365, and 367 which are analogous to steps 317, 319, 321, 323, 325, 327, and 329, respectively, with the exception that the air flow reduction in step 355 is more (e.g., blower 230 speed is lower) than the air flow reduction in step 317 or step 335. In some cases, the air flow is reduced to zero in step 355 (e.g., the blower 230 is turned off), while in other cases there is still air flow to enthalpy exchange zone 218. In some cases the time-limit set in step 339 can be different than the time-limit set in step 319.

Based on the present disclosure, one of ordinary skill would appreciate that the number of blower defrost modes could be increased or decreased compared to that depicted in FIG. 3A and FIG. 3B before a final decision step (e.g., step 367) depending on whether there is still a difference in the pressure difference or heat transfer efficiency compared to a pre-frosting operating condition and the a non-frost failure mode step 310 is activated.

FIG. 4A and FIG. 4B present a flow diagram of another example implementation of the method 100 in the case where the unit 200 does include a powered heat source 250 but does not include the secondary air intake opening 262. The same numbers indicate steps that are analogous to the steps described in FIG. 3A and FIG. 3B, with the exception that instead of a blower defrost mode step 315, there is a combined blower and heating defrost mode step 415, which can include activating the powered heat source 250 (an example of step 130, as part of step 105) and reducing the air flow such as described in the context of the defrost mode 315 disclosed in FIG. 3A.

In some cases, e.g., an electric heater 250 can be staged to different heating levels based on an outside air temperature measured in the air-intake zone 210 the control module 245 can lower the intake air blower 230 speed, and electric heater 250 heater operated at a low heating level, until the pressure difference across the enthalpy zone 218 (e.g., an enthalpy wheel intake pressure minus a the wheel exhaust pressure) are at pre-frost conditions. If frosting is not addressed, the speed of the blower 230 can be reduced to an allowable minimum and the electric heater will operate at a higher heating level.

Aspects of another embodiment of staged heating are further illustrated in FIG. 5A and FIG. 5B which present a flow diagram of another example implementation of the method 100 in the case where the unit 200 does include a powered heat source 250 but not the secondary air-intake opening 262. Again, the same numbers indicate steps that are analogous to the steps described in FIG. 3A and FIG. 3B. Instead of a blower defrost mode step 315, or combined blower defrost mode and heating mode step 415 (FIG. 4A), there is a staged heating defrost mode step 515 (an example of step 130 as part of step 105). In step 517, it is determined if the outside air temperature is below a pre-selected temperature. If the outside air temperature is above the pre-selected temperature then at step 519, a low level of heating is selected (an example of step 132). If the outside air temperature is below the pre-selected temperature, then at step 521, a high level of heating is selected (again an example of step 132). Alternatively, if after the time-limit set in step 319 has expired and there is still a difference in the pressure difference or heat transfer efficiency compared to a pre-frosting operating condition, the heating can transition at step 323 from the low level (step 519) to the high level (step 521). If after the time-limit set in step 337 has expired and there is still a difference in the pressure difference or heat transfer efficiency compared to a pre-frosting operating condition, the staged heating mode step 515 can transition at step 523 to the combined blower defrost mode and heating mode step 415 as described in FIG. 4A.

In some cases, e.g., an electric heater 250 is staged in as quickly as possible to facilitate continued delivery the correct amount of fresh air. The pressure across the enthalpy zone 218 can be monitoring to determine if defrost has been completed by observing that the pressure difference has reverted back to pre-frosted level.

FIG. 6A, FIG. 6B and FIG. 6C present a flow diagram of another example implementation of the method 100 in the case where the unit 200 does include a powered heat source 250 and the secondary air-intake opening 262. Again, the same numbers indicate steps that are analogous to the steps described in FIG. 3A, FIG. 3B, FIG. 5A and FIG. 5B. Instead of a blower defrost mode step 315, there is a combined blower and staged heating defrost mode step 615 which can include activating an air controller assembly 260 and a heat source 270 of an air-handler unit 272 (examples of steps 140 and 145, respectively as part of step 105).

After starting the defrost mode, a heat source 270 of an air-handler unit 272 can be activated in step 617, e.g., as a preheating step. After step 517, but before either of steps 519 or 521, there is a step 619 of reducing the air flow to the enthalpy exchange zone 218 (e.g., similar to step 317) plus activating an air controller assembly 260 (e.g., to open dampers covering the secondary air-intake opening 262). In step 621 it is determined if the secondary air-intake opening 262 is fully open and pressure in the unit 200 is at or slightly below a global pressure value (e.g., such as further described in Appl-3). If the pressure in the unit 200 is too low, then the intake air flow is increases (e.g., by increasing the blower 230 speed) in step 623. Steps 619, 621 and 623 are followed by either of steps 519 or 521 depending on the decision made in step 517. Subsequent steps are similar to the steps presented in FIG. 3A, FIG. 3B or FIG. 5A, FIG. 5B.

In some cases, e.g., the control module 245 will slow down intake blower 230 to a minimum accepted air-flow and open up dampers 264 of the air controller assembly 260 until pressure at the air-handler 272 is the same as the ambient pressure. An electric heater 250 will energize at maximum heating capacity until the pressure difference across the enthalpy exchange zone 218 is at a pre-frost condition. Then the damper will slowly close as the intake blower 230 speed increases back to it normal set point.

Those skilled in the art to which this application relates will appreciate that other and further additions, deletions, substitutions and modifications may be made to the described embodiments.

What is claimed is:

1. A method of defrosting an energy recovery ventilator unit, comprising:

activating a defrost process of an enthalpy-exchange zone of the energy recovery ventilator unit when an air-flow blockage in the enthalpy-exchange zone coincides with a frost threshold in the ambient environment surrounding the energy recovery ventilator unit; and terminating the defrost process when a heat transfer efficiency across the enthalpy-exchange zone returns to within 10 percent of a pre-frosting heat transfer efficiency wherein, the heat transfer efficiency is proportional to a temperature difference between an intake air zone of the energy recovery ventilator and a supply air zone of the energy recovery ventilator divided by a temperature difference between an return air zone of the energy recovery ventilator and the intake air zone.

2. The method of claim 1, wherein the defrost process includes activating an electrically powered heater that is coupled to and covering an outside opening of an intake air zone of the energy recovery ventilator unit such that outside air entering the intake air zone is heated.

3. The method of claim 1, wherein the defrost process includes reducing airflow from an air intake zone located inside of the energy recovery ventilator unit to the enthalpy exchange-zone.

4. The method of claim 3, wherein the defrost process includes activating an air controller assembly so as to allow air-flow through a secondary air-intake opening connected to a supply zone located inside of the energy recovery ventilator unit.

5. The method of claim 4, wherein the reduction in the air flow from the air intake zone and an increase in the air-flow through the secondary air-intake opening are coordinated such that the total amount of outdoor air entering the ventilator is preserved.

6. The method of claim 4, wherein the defrost process further includes activating a heat source of an air-handling unit coupled to the energy recovery ventilator unit, such that the air exiting the air-handling unit is heated to a same temperature than before the defrosting process was activated.

7. The method of claim 6, wherein the heat source in the air-handling unit is activated at the same time, or before, the air controller assembly is activated.

8. An energy recovery ventilator unit, comprising:

a defrost control module configured to:

activate a defrost process of an enthalpy-exchange zone of the energy recovery ventilator unit when an air-flow blockage in the enthalpy-exchange zone coincides with a frost threshold in the ambient environment surrounding the energy recovery ventilator unit; and terminate the defrost process when a heat transfer efficiency across the enthalpy-exchange zone returns to within 10 percent of a pre-frosting heat transfer efficiency wherein, the heat transfer efficiency is proportional to a temperature difference between an intake air zone of the energy recovery ventilator and a supply air zone of the energy recovery ventilator divided by a temperature difference between an return air zone of the energy recovery ventilator and the intake air zone.

9. The unit of claim 8, further including temperature sensors configured to measuring air temperatures of the intake air zone, the supply air zone, and the return air zone inside of the energy recovery ventilator unit and configured to transmit the measured air temperatures to the defrost control module.

10. The unit of claim 8, further including an electrically powered heat source configured to warm air in the intake air zone, wherein the defrost control module is configured to activate or deactivate the electrically powered heat source such that outside air entering the intake air zone is heated.

11. The unit of claim 10, wherein the electrically powered heat source is a modular electric heater configured to be coupled to the outside of the energy recovery ventilator unit and located upstream of an air intake opening of the intake air zone.

* * * * *